US010619528B2

(12) United States Patent
Cecil

(10) Patent No.: US 10,619,528 B2
(45) Date of Patent: Apr. 14, 2020

(54) COMPRESSION BRAKE FOR INTERNAL COMBUSTION ENGINE

(71) Applicant: Cummins Inc., Columbus, IN (US)

(72) Inventor: Adam C. Cecil, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/002,416

(22) Filed: Jun. 7, 2018

(65) Prior Publication Data

US 2018/0283241 A1 Oct. 4, 2018

Related U.S. Application Data

(63) Continuation of application No. PCT/US2015/066296, filed on Dec. 17, 2015.

(51) Int. Cl.

| | |
|---|---|
| ***F01L 13/06*** | (2006.01) |
| ***F01L 1/24*** | (2006.01) |
| ***F01L 1/08*** | (2006.01) |
| ***F02D 13/04*** | (2006.01) |
| ***F01L 1/14*** | (2006.01) |
| ***F01L 13/00*** | (2006.01) |
| ***F01L 1/047*** | (2006.01) |
| ***F01L 1/255*** | (2006.01) |

(52) U.S. Cl.

CPC ..... *F01L 13/06* (2013.01); *F01L 1/047* (2013.01); *F01L 1/08* (2013.01); *F01L 1/14* (2013.01); *F01L 1/24* (2013.01); *F01L 1/2422* (2013.01); *F01L 1/255* (2013.01); *F01L 13/0005* (2013.01); *F02D 13/04* (2013.01)

(58) Field of Classification Search

CPC ..... F01L 13/06; F01L 13/0005; F01L 1/08; F01L 1/14; F01L 1/24; F01L 1/2422; F01L 1/255; F02D 13/04

USPC ..... 123/90.17, 90.15, 90.16, 90.18

See application file for complete search history.

(56) References Cited

U.S. PATENT DOCUMENTS

| | | | | |
|---|---|---|---|---|
| 3,786,792 | A | 1/1974 | Pelizzoni et al. | |
| 5,626,116 | A | 5/1997 | Reedy et al. | |
| 5,720,244 | A | 2/1998 | Faria | |
| 5,839,453 | A | 11/1998 | Hu | |
| 5,934,232 | A | 8/1999 | Greene | |
| 6,000,374 | A | 12/1999 | Cosma et al. | |
| 6,253,730 | B1 | 7/2001 | Gustafson | |
| 6,321,704 | B1 | 11/2001 | Church et al. | |
| 6,439,195 | B1 | 8/2002 | Warner | |
| 6,694,933 | B1 * | 2/2004 | Lester | F01L 13/0031 123/198 F |
| 7,036,481 | B2 | 5/2006 | Sailer et al. | |
| 7,520,262 | B2 | 4/2009 | Jeong et al. | |

(Continued)

OTHER PUBLICATIONS

International Search Report and Written Opinion, PCT/US15/66296, ISA/US, Cummins Inc., dated Feb. 26, 2016.

*Primary Examiner* — Patrick Hamo
*Assistant Examiner* — Kelsey L Stanek
(74) *Attorney, Agent, or Firm* — Taft Stettinius & Hollister LLP

(57) ABSTRACT

An engine compression braking system includes a brake tappet linking an exhaust cam to at least one exhaust valve of an engine cylinder. The brake tappet is connected with a working fluid that selectively activates and deactivates a compression braking mode of operation by selectively engaging and releasing a lash assembly of the brake tappet relative to a housing of the brake tappet.

20 Claims, 5 Drawing Sheets

(56) References Cited

U.S. PATENT DOCUMENTS

| | | | | |
|---|---|---|---|---|
| 7,900,597 | B2 | 3/2011 | Meneely | |
| 7,921,823 | B2 | 4/2011 | Sailer et al. | |
| 8,037,865 | B2 | 10/2011 | Meneely et al. | |
| 8,196,556 | B2 | 6/2012 | Hendriksma | |
| 8,272,363 | B2 | 9/2012 | Meneely et al. | |
| 8,387,590 | B2 | 3/2013 | Bolte et al. | |
| 2010/0319657 | A1 | 12/2010 | Dodi et al. | |
| 2012/0186545 | A1 | 7/2012 | Cecur | |
| 2012/0186546 | A1* | 7/2012 | Cecur | F01L 1/146 123/90.15 |
| 2014/0182536 | A1 | 7/2014 | Yang | |

* cited by examiner

COMPRESSION BRAKE FOR INTERNAL COMBUSTION ENGINE

CROSS-REFERENCE TO RELATED APPLICATION

The present application is a continuation of International Patent App. No. PCT/US15/66296 filed on Dec. 17, 2015, the disclosure of which is hereby incorporated herein by reference in its entirety.

TECHNICAL FIELD

This invention relates to compression brakes for internal combustion engines.

BACKGROUND

Compression braking is known in the art and is used for many applications, including braking heavy vehicles. Compression brakes convert an internal combustion engine cylinder to a compressor during a zero fuel flow event and open an exhaust valve of the cylinder near the end of the compression stroke. This allows the power generated in the piston to escape to the atmosphere, rather than continuing to power the vehicle. One type of compression braking system is shown in U.S. Pat. No. 6,253,730 to Gustafson.

Compression braking in light duty engines has heretofore been met with difficulties due to, among other issues, the high cost in providing compression brake components and a lack of space in the engine footprint to accommodate the compression brake system. Therefore, further improvements in this technological area are desired.

SUMMARY

Systems, apparatus, and methods are disclosed herein relating to a compression braking system that can be implemented in light duty internal combustion engines without requiring significant changes to major components of existing light duty internal combustion engine platforms. Applications of the disclosed compression braking system and/or components thereof in heavy duty and mid-range internal combustion engines are also contemplated.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DETAILED DESCRIPTION

Figure 1:
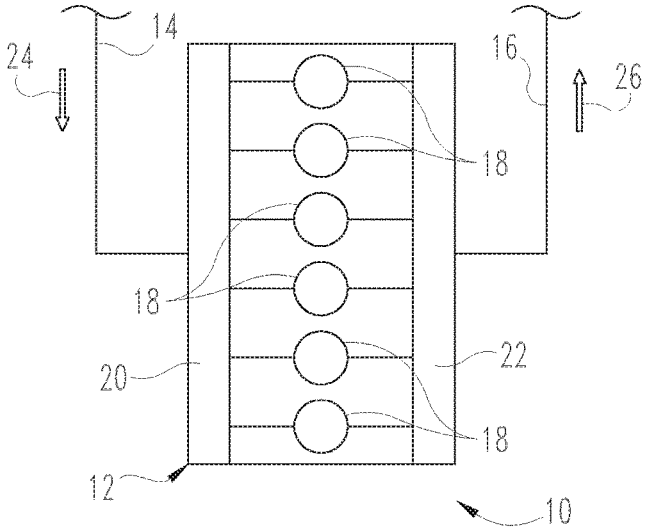
FIG. 1 is a schematic diagram of an internal combustion engine.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

FIG. 1 shows an internal combustion engine system 10 according to one embodiment of the present application. System 10 includes an internal combustion engine 12 having an intake system 14 and an exhaust system 16. Engine 12 can be any type of engine, and in one specific embodiment is a diesel engine that includes a number of cylinders 18 each housing a piston. Cylinders 18 receive an intake flow 24 and combust a fuel provided thereto to produce an exhaust flow 26 from each of the cylinders. In the illustrated embodiment, engine 12 includes six cylinders connected with an intake manifold 20 and an exhaust manifold 22. Engine 12 can be an in-line type engine with a single cylinder bank, although other embodiments include V-shaped cylinder arrangements, a W-type engine, or any engine arrangement with one or more cylinders. It is contemplated that engine 12 is provided as part of a powertrain for a vehicle (not shown).

Figure 2:
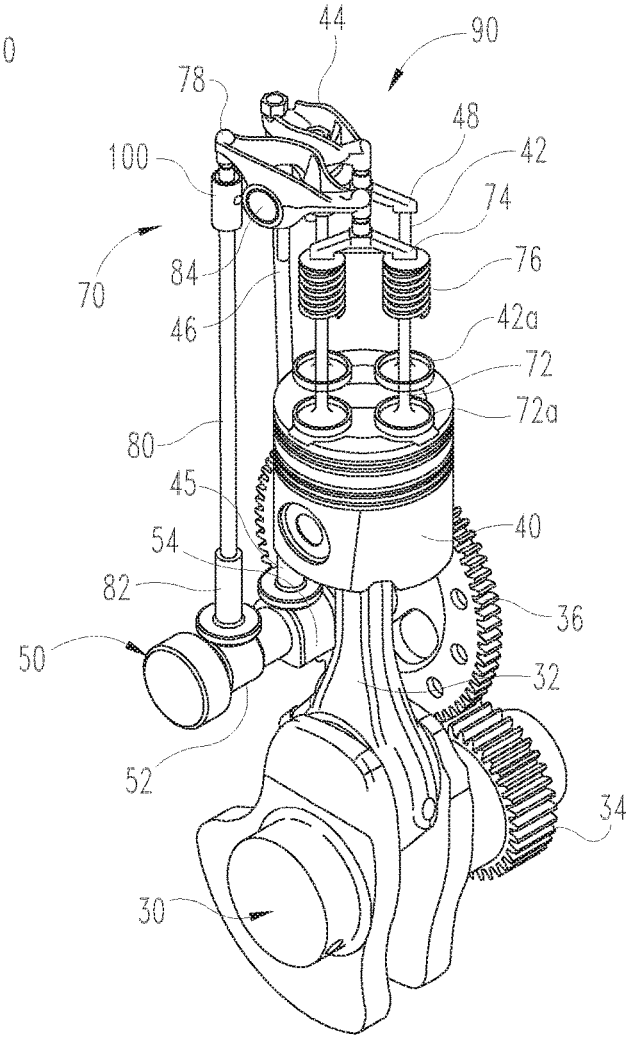
FIG. 2 is a perspective view of a portion of the internal combustion engine of FIG. 1 including a compression braking system.

Referring to FIG. 2, there is illustrated one embodiment of a portion of engine 12 including crankshaft 30, a piston 40, a camshaft 50, and a valve opening mechanism 90 that includes a compression braking system 70. Piston 40 is housed in a respective one of the cylinders 18, and is rotatably connected to crankshaft 30 with a connecting rod 32 so that reciprocating movement of piston 40 rotates crankshaft 30, as known in the art. Crankshaft 30 also includes a first gear 34, and first gear 34 is connected to a second gear 36 that is connected to camshaft 50. Rotation of crankshaft 30 rotates camshaft 50 at, for example, half speed of crankshaft 30 with gears 34, 36 providing a gear reduction, as known in the art. Other embodiments contemplate other types of connections between crankshaft 30 and camshaft 50, such as a chain or belt drive.

Each cylinder 18 of engine 12 houses a piston 40 that is connected to crankshaft 30 and camshaft 50. Each cylinder 18 also includes at least one intake valve 42 that is opened and closed by a valve opening mechanism 90 connected to an intake cam lobe 54 of camshaft 50. The opening of the intake valve(s) 42 allow a charge flow to be admitted into the combustion chamber of the respective cylinder 18 through an intake opening 42*a*. In the illustrated embodiment, the intake valve 42 includes first and second intake valves connected by an intake cross head-head 48. Intake cross head-head 48 is connected to an intake rocker 44, which is rotatable about a rocker axis in response to an intake valve opening lobe of intake cam 54 pushing on the intake push rod 46 as the intake valve opening lobe of intake cam 54 passes against intake cam follower tappet 45 at the end of push rod 46.

Each cylinder 18 further includes at least one exhaust valve 72. Opening of the at least one exhaust valve 72 with valve opening mechanism 90 allows exhaust gases created by combustion of the charge flow to escape the combustion chamber of the respective cylinder 18 through an exhaust opening 72*a*. In the illustrated embodiment, the exhaust valve 72 includes first and second exhaust valves connected by an exhaust cross head-head 74. Each exhaust valve(s) 72 further includes an exhaust valve spring(s) 76 actuated by an exhaust rocker 78 through exhaust cross head-head 74 (if provided) to open and close the exhaust valve(s) 72 in response to an exhaust valve opening lobe on exhaust cam 52 acting on exhaust push rod 80. Valve opening mechanism 90 further includes compression braking system 70 employing a brake tappet 100. Brake tappet 100 is operable to provide for compression braking using exhaust valves 72 when a compression braking mode of operation is activated, as discussed further below.

In the illustrated embodiment, compression braking system 70 includes an exhaust push rod 80 that extends through a bore in a block of engine 12, and is engaged to exhaust cam 52 with a cam follower tappet 82. Cam follower tappet 82 is engaged to an end of an exhaust push rod 80. Exhaust push rod 80 translates in response to rotation of one or more lobes of exhaust cam 52 acting on cam follower tappet 82 and acts through brake tappet 100 to pivot exhaust rocker 78 about a rocker shaft 84.

Figure 3A:
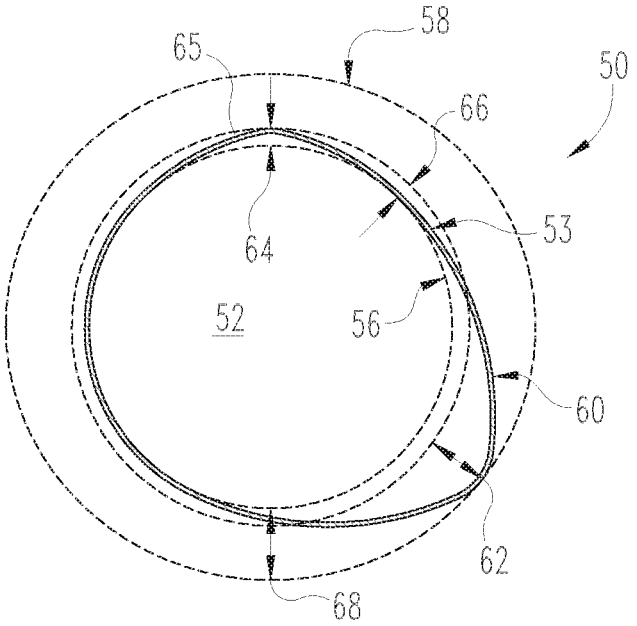
FIGS. 3A and 3B are cross-sectional schematic illustrations of an exhaust cam lobe and an intake cam lobe, respectively, of a camshaft of the compression braking system of FIG. 2.

Referring to FIG. 3A, there is shown a cross-sectional view of camshaft 50 through exhaust cam 52. Exhaust cam 52 includes a profile 53 that defines an inner base circle 56 and an outer base circle 58. Outer base circle 58 is defined by the maximum outer dimension of exhaust lobe 60. As known in the art, exhaust lobe 60 is configured to open exhaust valve(s) 72 of the respective cylinder 18 during an exhaust stroke of piston 40 to expel exhaust gases to exhaust manifold 22 as exhaust lobe 60 rotates against cam follower tappet 82.

Exhaust cam 52 further includes a brake bump portion 64 defined by a brake lobe 65. Brake lobe 65 is spaced along inner base circle 56 from exhaust lobe 60 so that an exhaust valve lift event can be provided by compression braking system 70 at or near the end of the compression stroke of piston 40 in cylinder 18, allowing engine 12 to act as a power absorbing device to slow the vehicle through the power train rather than through friction braking by the vehicle's service brakes. In other embodiments, more than one brake bump lift 64 could be provided on exhaust cam 52.

Exhaust cam 52 defines a maximum valve lift 68 for exhaust valve(s) 72 that is provided by push rod 80 being fixed relative to brake tappet 100. In the fixed condition, exhaust valve(s) 72 are lifted from their respective valve seats by a distance corresponding to maximum valve lift 68 when compression braking system 70 is activated. When the compression braking system 70 is deactivated, push rod 80 is able to translate relative to brake tappet 100 to absorb brake bump portion 64. Thus, a second valve lift 62 for the exhaust valve(s) 72 is provided that is less than maximum valve lift 68 since the compression braking system 70 is configured to absorb brake bump portion 64. This difference in valve lift is defined by a deactivation region 66 corresponding to the height of brake bump lift 65 above inner base circle 56. Absorbing the lift created by brake bump portion 64 with brake tappet 100 prevents the exhaust valve(s) 72 from opening as the brake lobe 65 contacts cam follower tappet 82.

Figure 3B:
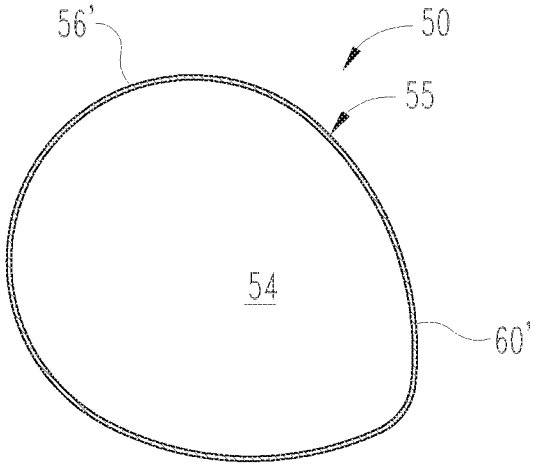

Referring to FIG. 3B, there is shown a cross-sectional view of camshaft 50 through intake cam 54. Intake cam 54 includes an outer profile 55 that defines a base circle 56' and an intake lobe 60', which differ from the base circle and exhaust lobe of exhaust cam 52. As known in the art, intake lobe 60' is configured to open intake valve(s) 42 of the respective cylinder 18 during an intake stroke of piston 40 to admit a charge flow into the combustion chamber of the respective cylinder 18 as intake lobe 60' rotates against the cam follower tappet connected to the intake rocker 44 associated with intake valve(s) 42. Intake cam 54 can include any other lobe configurations known in the art.

Figure 4C:
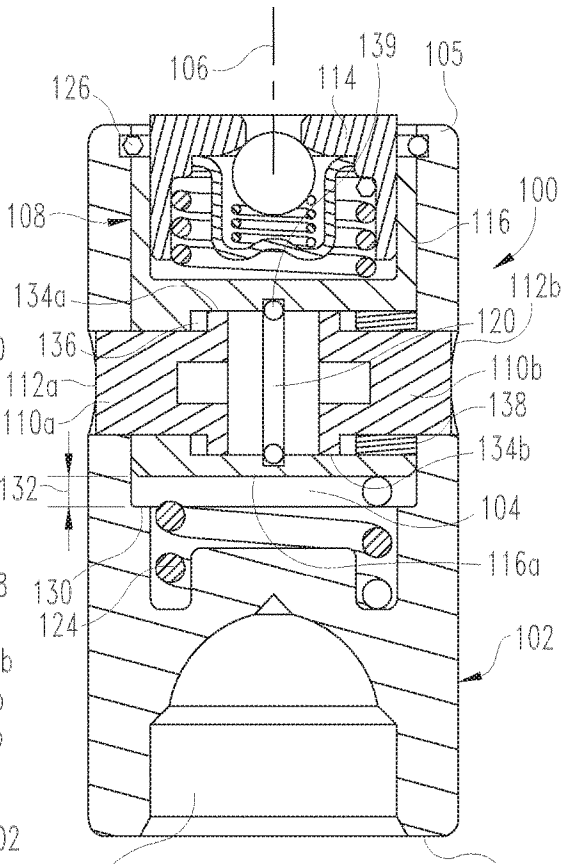
FIGS. 4A-4C are cross-sectional illustrations of a brake tappet of the compression braking system of FIG. 2 in various operational states.
Figure 4B:
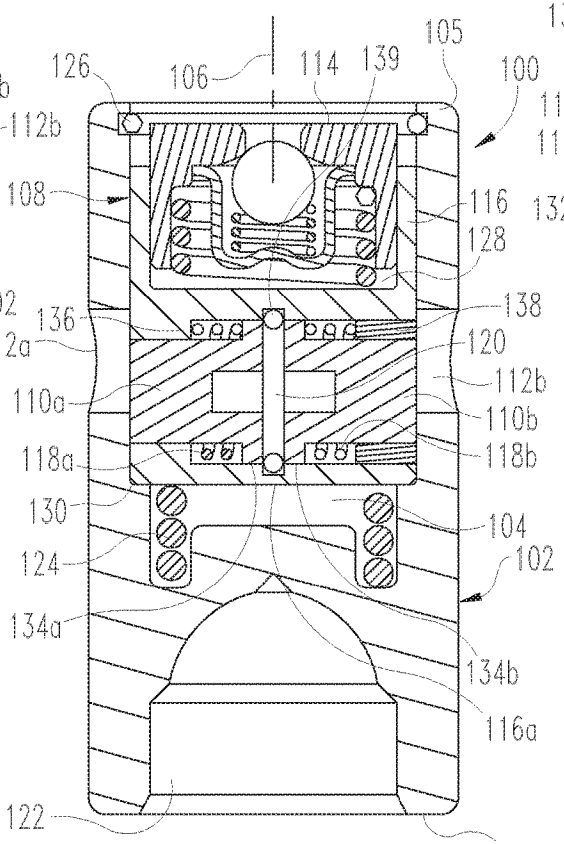
Figure 4A:
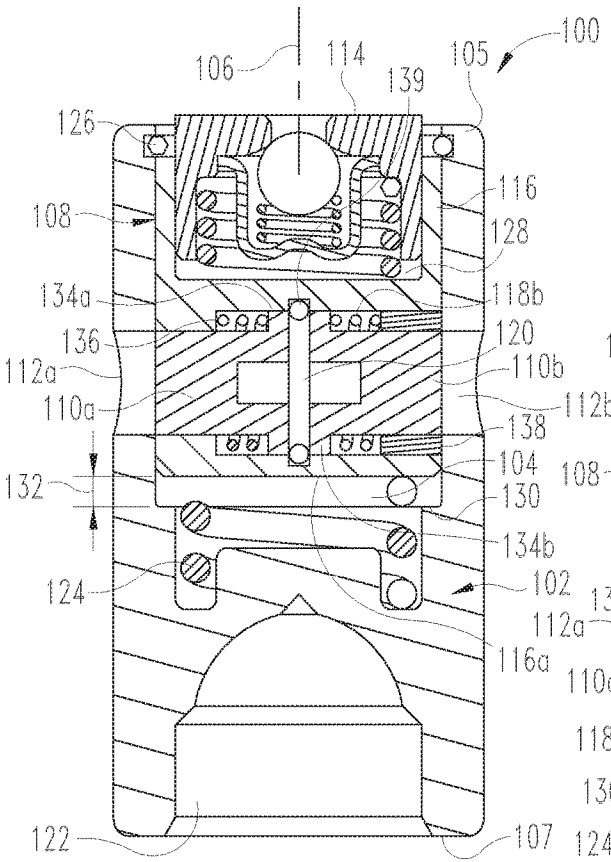

Referring to FIGS. 4A-4C, there is shown one embodiment of brake tappet 100. Brake tappet 100 includes a cylindrical housing 102 extending along a longitudinal axis 106 between a first end 105 and an opposite second end 107. Housing 102 defines an interior 104 that opens at first end 105 and is closed at second end 107. Second end 107 defines a socket 122 for receiving an end of push rod 80.

Housing 102 houses a lash assembly 108 that includes a lash adjuster 116 that is biased toward first end 105 with lash spring 124. A retention clip 126 is engaged in interior 104 at first end 105, and retention clip 126 is configured to maintain lash assembly 108 in housing 102 while lash adjuster 116 is biased against retention clip 126 with lash spring 124. Lash assembly 108 also includes an optional check valve 114 also positioned at first end 105 of housing 102 in a cavity 128 formed by lash adjuster 116. Check valve 114 is configured to admit a working fluid under pressure to adjust the positioning of lash adjuster 116 along longitudinal axis 106 of housing 102.

Lash assembly 108 is longitudinally movable in housing 102 from a first, unlocked position shown in FIG. 4A to a second unlocked position shown in FIG. 4B. In FIG. 4A, cam follower tappet 82 is in contact with exhaust cam 52 along inner base circle 56 of exhaust cam 52. Lash assembly 108 defines a deactivation region 132 in interior 104 between an end 116*a* of lash adjuster 116 and interior lip 130 of housing 102. In FIG. 4B, the lift provided by brake bump portion 64 is absorbed by translation of lash assembly 108 in housing 102 across deactivation region 132 so that the end 116*a* of lash adjuster 116 contacts interior lip 130.

Brake tappet 100 also includes first and second locking pins 110*a*, 110*b* that are supported in a galley 120 defined by lash adjuster 116. First and second locking pins 110*a*, 110*b* are separated by a switching portion of galley 120 therebetween that receives the working fluid. Housing 102 further defines opposite first and second locking receptacles 112*a*, 112*b* that are normally aligned with respective ones of the first and second locking pins 110*a*, 110. Each of the first and second locking pins 110*a*, 110*b* is normally biased to a recessed position, as shown in FIGS. 4A and 4B, by respective ones of first and second biasing members 118*a*, 118*b*. Biasing members 118*a*, 118*b* contact a corresponding flange 134*a*, 134*b* of locking pins 110*a*, 110*b* and respective ones of an inner ledge 136 of lash adjuster 116 and bushing 138. Spacer 139 in switching galley 120 maintains a minimum spacing between the facing sides of the inwardly biased locking pins 110*a*, 110*b*.

When compression braking system 70 is deactivated, first and second locking pins 110*a*, 110*b* are recessed into lash adjuster 116 to allow longitudinal movement of lash assembly 108 in housing 102 as shown in FIGS. 4A and 4B. When compression braking is desired, compression braking system 70 is activated by pressurizing the working fluid in the switching portion of galley 120 to overcome the biasing force of first and second biasing members 118*a*, 118*b*, displacing the first and second locking pins 110*a*, 110*b* outwardly into locking receptacles 112*a*, 112*b* to axially lock lash assembly 108 to housing 102, as shown in FIG. 4C. As a result of this locking, exhaust push rod 80 is axially fixed relative to brake tappet 100 and brake bump portion 64 is operable to translate exhaust push rod 80 to rotate exhaust rocker 78 and open exhaust valve(s) 72 for compression braking operation.

Figure 5:
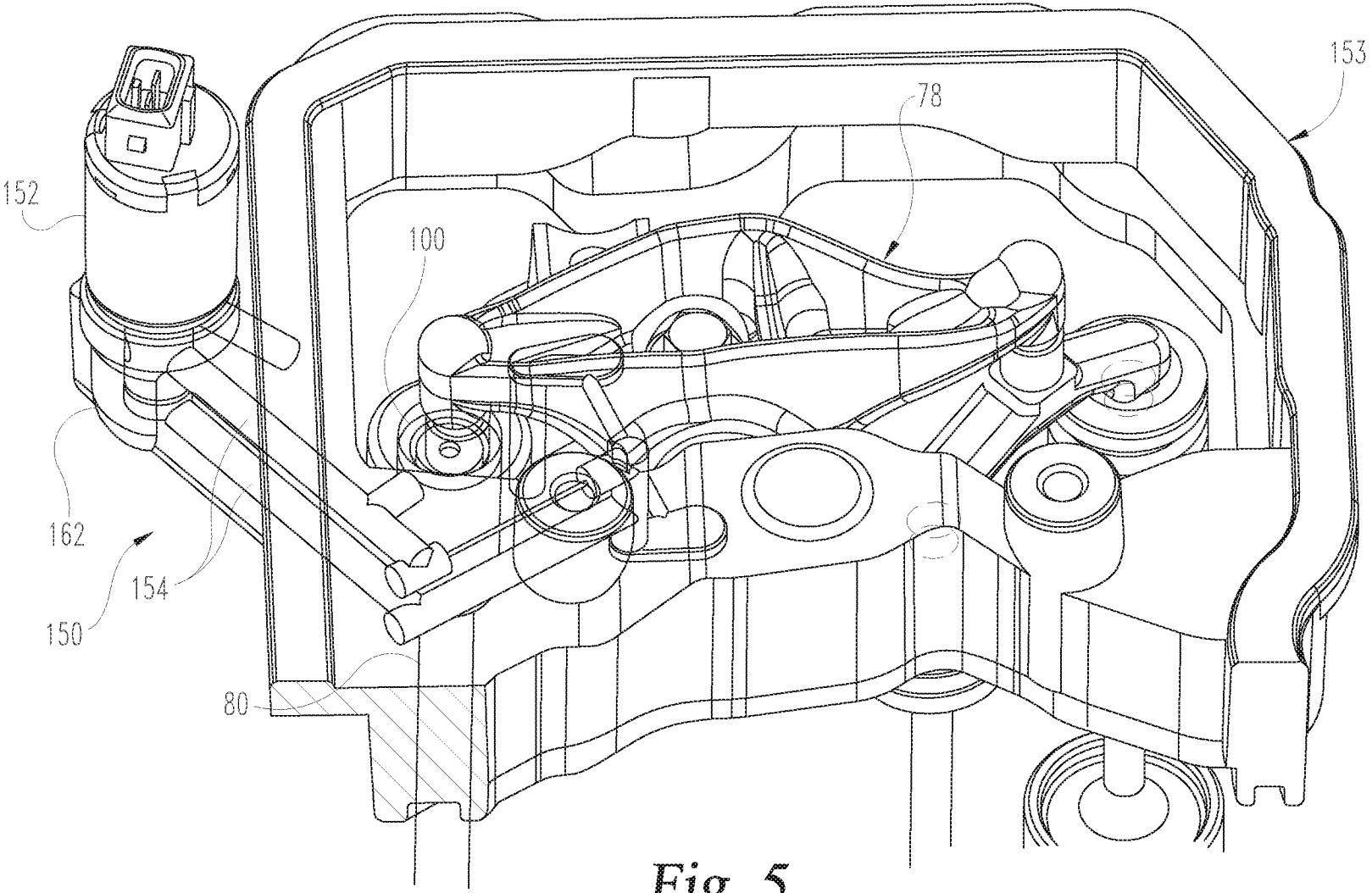
FIG. 5 is a schematic perspective view of a working fluid actuating system and housing for selectively activating and deactivating the brake tappet of FIGS. 4A-4C.
Figure 6:
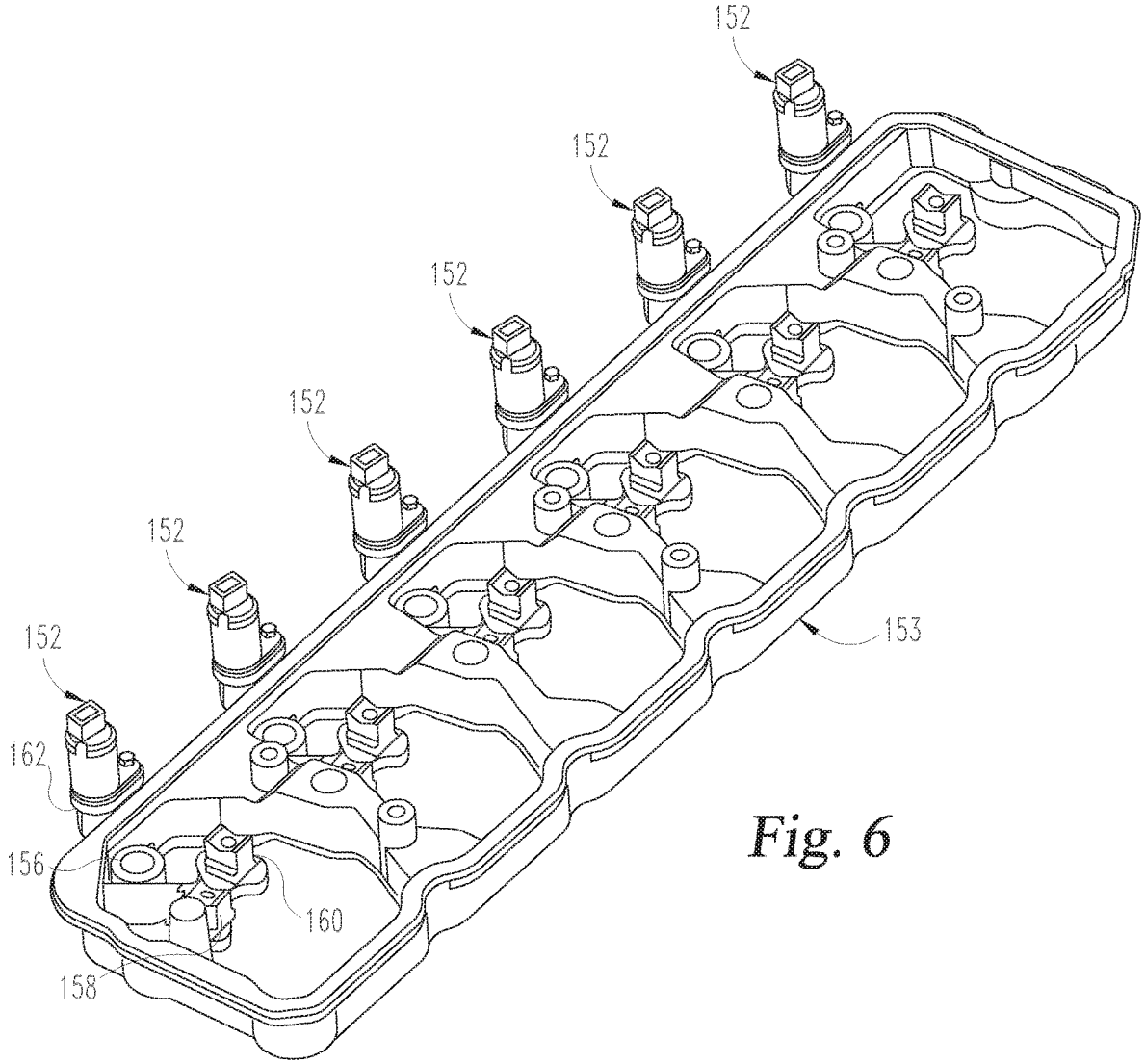
FIG. 6 is a perspective view of one embodiment of a working fluid actuator for the compression braking system.

One embodiment of a hydraulic system 150 for activating and deactivating the compression braking mode of operation is shown in FIGS. 5-6 with a working fluid, such as engine oil. Hydraulic system 150 includes a solenoid 152 mounted to a compression braking system support housing 153. Support housing 153 further includes a platform 162 for each solenoid 152. Support housing 153 further defines a number of fluid flow paths 154 for providing a flow of the working fluid via solenoid 152 through fluid flow paths 154.

The fluid flow paths 154 are in fluid communication with at least the switching portion of galley 120 of brake tappet 100. When the working fluid is held below a first pressure threshold, locking pins 110*a*, 110*b* are maintained in the unlocked position with the force of biasing members 118*a*, 118*b*. When a compression braking mode of operation is desired, solenoid 152 is activated to increase the working fluid pressure and overcome the biasing force of biasing member 118*a*, 118*b* to force locking pins 110*a*, 110*b* outwardly into locking receptacles 112*a*, 112*b*.

As shown in FIG. 6, support housing 153 can be configured to provide a platform 162 for connection of a corresponding solenoid 152 for each of the cylinders 18 of engine 12, which is six cylinders in the illustrated embodiment. Support member 153 further includes a bore 156 for exhaust push rod 80, and pedestals 158, 160 for rockers 78 and 44, respectively. Support housing 153 further includes openings for the exhaust and intake valves and cross head-heads connecting the same for each valve opening mechanism 90. In one embodiment, support housing 153 on top of the cylinder head of engine 12.

Brake tappet 100 could also be used in an overhead camshaft (cam-in-head) configuration where the cam follower tappet 82 and the push rod 80 are not part of the compression braking system, and the exhaust cam 52 of camshaft 50 directly actuates the brake tappet 100. In other embodiments, the cross head-head 74 is omitted from the compression braking system.

The embodiment in FIG. 6 employs one solenoid 152 per cylinder 18, but other embodiments contemplate that one solenoid 152 actuates a brake tappet for multiple cylinders 18. The solenoid(s) 152 could also be connected to a vehicle control system that allows the driver to select all or a portion of the cylinders 18 to employ in compression braking operation depending on the braking needs. This control could also be integrated within the vehicle control systems to provide the appropriate level of compression braking using inputs such as brake pedal effort or position.

The brake tappet 100 could also be incorporated to replace the cam follower tappet 82 at the end of push rod 80 so that the exhaust cam 52 directly engages the brake tappet 100 to act on push rod 80. In the illustrated embodiment, the nominal or default position of locking pins 110*a*, 110*b* is achieved by providing a lower or zero working fluid pressure in the switching portion of galley 120 between locking pins 110*a*, 110*b*. In other embodiments, a positive working fluid pressure is provided to interior 104 of housing 102 to force locking pins 110*a*, 110*b* out of engagement with receptacles 112*a*, 112*b*, and locking pins 110*a*, 110*b* are normally biased into engagement with receptacles 112*a*, 112*b*.

Many aspects of the present invention are envisioned. For example, one aspect is directed to a compression braking system for an internal combustion engine. The system includes a cylinder housing a piston operably connected to a crankshaft. The cylinder further includes at least one intake valve and at least one exhaust valve for selectively opening and closing respective ones of at least one intake opening and at least one exhaust opening of the cylinder. The system further includes a camshaft with a first cam and a second cam that are rotatable with rotation of the camshaft. The first cam defines an inner base circle portion, a first cam lobe projecting from the inner base circle portion, and a brake bump portion projecting from the inner base circle portion. The second cam defines a second base circle portion and a second cam lobe projecting from the second base circle portion. The system also includes a valve opening mechanism linking the first and second cams to respective ones of the at least one exhaust valve and the at least one intake valve. The valve opening mechanism includes a brake tappet linking the at least one exhaust valve to the first cam. In a non-compression braking mode the brake tappet is configured to absorb the brake bump portion when the valve opening mechanism is in contact with the brake bump portion without opening the at least one exhaust valve and to open the at least one exhaust valve in response to the first cam lobe being in contact with the valve opening mechanism. In a compression braking mode the brake tappet opens the at least one exhaust valve in response to each of the brake bump portion and the first cam lobe being in contact with the valve opening mechanism.

In one embodiment, the valve opening mechanism includes a rocker lever connected to the at least one exhaust valve, a cam follower tappet contacting the first cam, and a push rod connecting the cam follower tappet to the brake tappet. In a refinement of this embodiment, in the non-compression braking mode the push rod is configured to translate relative to the brake tappet in response to the brake bump portion contacting the cam follower tappet so the at least one exhaust valve remains closed.

In another refinement, in response to the first cam lobe contacting the cam follower tappet in the non-compression braking mode, the push rod translates relative to the brake tappet a first distance corresponding to a height of the brake bump portion from the inner base circle portion, and the push rod is fixed relative to the brake tappet along a remaining portion of the first cam lobe to open the at least one exhaust valve.

In yet another refinement, in the compression braking mode the push rod is fixed relative to the brake tappet so the at least one exhaust valve opens in response to the brake bump portion contacting the cam follower tappet. In still another refinement, the valve opening mechanism includes a second rocker lever connected to the intake valve, an intake cam follower tappet contacting the second cam, and an intake push rod connecting the intake cam follower tappet to the second rocker arm. In a further refinement, the at least one exhaust valve includes two exhaust valves and a first cross head connects the two exhaust valves to the rocker lever, and the at least one intake valve includes two intake valves and a second cross head connects the two intake valves to the second rocker lever.

In another embodiment, the brake tappet includes a housing extending along a longitudinal axis between a first end and an opposite second end, and the housing defines an interior for receiving a working fluid. The brake tappet also includes a lash assembly in the interior of the housing. The lash assembly is longitudinally movable in the housing in the non-compression braking mode and longitudinally fixed to the housing by a change in pressure in the working fluid in the compression braking mode.

In a refinement of this embodiment, the housing further includes opposite first and second locking receptacles in communication with the interior, and the lash assembly further includes first and second locking pins in the interior of the housing. The first and second locking pins are movable in response to a change in pressure of the working fluid from a first position in which the locking pins are positioned within the interior in disengagement from the locking receptacles and a second position in which the locking pins are forced outwardly under pressure from the working fluid into engagement with the locking receptacles.

In a further refinement, the lash assembly includes a check valve in the interior at the first end of the housing to control a flow of working fluid into and out of the interior of the housing. The lash assembly further includes a lash adjuster extending from the check valve toward the second end of the housing. The first and second locking pins are housed in a galley of the lash adjuster, and the lash adjuster is longitudinally movable in the housing when in the non-compression braking mode to accommodate the brake bump portion of the first cam without opening the at least one exhaust valve.

In yet a further refinement, a first biasing member biases the first locking member relative to the lash adjuster to the first position and a second biasing member biases the second locking member relative to the lash adjuster to the first position. In still a further refinement, the first and second locking pins define a switching portion of the galley therebetween for receiving the working fluid. The change in pressure in the working fluid forces the first and second locking pins away from one another to move the first and second locking pins from the first position to the second position.

In another aspect, a compression braking system for an internal combustion engine includes a brake tappet that is configured to link at least one exhaust valve to an exhaust cam. The exhaust cam includes a brake bump portion and an exhaust lobe. The brake tappet includes a housing extending along a longitudinal axis and a lash assembly in an interior of the housing, and the lash assembly is longitudinally movable relative to the housing. The system includes first and second locking pins in the housing movable relative to the lash assembly to selectively fix and release the lash assembly relative to the housing. In a non-compression braking mode the locking pins are positioned so the lash assembly is longitudinally movable relative to the housing to absorb the brake bump portion acting on the brake tappet without transferring the brake bump portion to the at least one exhaust valve and the lash assembly is movable with the housing in response to the exhaust lobe acting on the brake tappet to transfer the exhaust lobe to the at least one exhaust valve. In a compression braking mode the lash assembly is fixed relative to the housing so that the brake bump portion and the exhaust lobe of the exhaust cam are each transferred to the at least one exhaust valve.

In one embodiment, the housing extends along a longitudinal axis between a first end and an opposite second end, and the housing includes a working fluid in the interior of the housing. A change in pressure of the working fluid moves the first and second locking pins to selectively fix and release the lash assembly relative to the housing. In a refinement of this embodiment, the housing includes opposite first and second locking receptacles in communication with the interior, and the first and second locking pins are movable in response to the change in pressure of the working fluid to engage and disengage from respective ones of the first and second locking receptacles.

In another embodiment, the lash assembly includes a lash adjuster and the first and second locking pins are supported in a galley defined by the lash adjuster, and the lash assembly defines a deactivation region between a lip of the housing in the interior of the housing and an adjacent end of the lash adjuster. The deactivation region is configured to allow translation of the lash adjuster in the housing to absorb the brake bump portion in the non-compression braking mode.

In a refinement of this embodiment, the system includes first and second biasing members that extend between a respective one of the first and second locking pins and the lash adjuster to normally bias the locking pins toward one another and in the compression braking mode the first and second locking pins are forced outwardly away from another into engagement with the housing. In a further refinement, the lash adjuster defines a cavity opening toward a first end of the housing and the lash assembly includes a check valve in the cavity to control a flow of working fluid into and out of the interior of the housing.

In another refinement, the lash adjuster defines a galley and the first and second locking pins define a switching portion of the galley therebetween for receiving a working fluid that is pressurizable to move the first and second locking pins relative to one another. In yet another refinement, the lash assembly includes a lash spring in the interior of the housing biasing the lash adjuster toward the first end of the housing.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A compression braking system for an internal combustion engine, comprising:

a cylinder housing a piston operably connected to a crankshaft, the cylinder further including at least one intake valve and at least one exhaust valve for selectively opening and closing respective ones of at least one intake opening and at least one exhaust opening of the cylinder;

a camshaft including a first cam and a second cam, the first and second cams being rotatable with rotation of the camshaft, the first cam defining an inner base circle portion, a first cam lobe projecting from the inner base circle portion, and a brake bump portion projecting from the inner base circle portion, and the second cam defining a second base circle portion and a second cam lobe projecting from the second base circle portion; and a valve opening mechanism linking the first and second cams to respective ones of the at least one exhaust valve and the at least one intake valve, the valve opening mechanism including a brake tappet linking the at least one exhaust valve to the first cam, wherein in a non-compression braking mode the brake tappet is configured to absorb the brake bump portion in response to the brake bump portion being in contact with the valve opening mechanism without opening the at least one exhaust valve and to open the at least one exhaust valve in response to the first cam lobe being in contact with the valve opening mechanism, and in a compression braking mode the brake tappet opens the at least one exhaust valve in response to each of the brake bump portion and the first cam lobe being in contact with the valve opening mechanism, wherein the brake tappet includes:

a housing extending along a longitudinal axis between a first end and an opposite second end, the housing defining an interior for receiving a working fluid; and a lash assembly in the interior of the housing, the lash assembly including first and second locking pins in the interior housing that are forced outwardly by pressurizing the working fluid in the compression braking mode to longitudinally fix the lash assembly.

2. The compression braking system of claim 1, wherein the valve opening mechanism includes a rocker lever connected to the at least one exhaust valve, a cam follower tappet contacting the first cam, and a push rod connecting the cam follower tappet to the brake tappet.

3. The compression braking system of claim 2, wherein in the non-compression braking mode the push rod is configured to translate relative to the brake tappet in response to the brake bump portion contacting the cam follower tappet so the at least one exhaust valve remains closed.

4. The compression braking system of claim 2, wherein, in response to the first cam lobe contacting the cam follower tappet in the non-compression braking mode, the push rod translates relative to the brake tappet a first distance corresponding to a height of the brake bump portion from the inner base circle portion, and the push rod is fixed relative to the brake tappet along a remaining portion of the first cam lobe to open the at least one exhaust valve.

5. The compression braking system of claim 2, wherein in the compression braking mode the push rod is fixed relative to the brake tappet so the at least one exhaust valve opens in response to the brake bump portion contacting the cam follower tappet.

6. The compression braking system of claim 2, wherein the valve opening mechanism includes a second rocker lever connected to the intake valve, an intake cam follower tappet contacting the second cam, and an intake push rod connecting the intake cam follower tappet to the second rocker arm.

7. The compression braking system of claim 6, wherein the at least one exhaust valve includes two exhaust valves and further comprising a first cross head connecting the two exhaust valves to the rocker lever, and the at least one intake valve includes two intake valves and further comprising a second cross head connecting the two intake valves to the second rocker lever.

8. The compression braking system of claim 1, wherein the lash assembly is longitudinally movable in the housing in the non-compression braking mode and longitudinally fixed to the housing by a change in pressure in the working fluid in the compression braking mode.

9. The compression braking system of claim 8, the housing further including opposite first and second locking receptacles in communication with the interior, and the first and second locking pins being movable in response to a change in pressure of the working fluid from a first position during the non-compression braking mode in which the locking pins are positioned within the interior in disengagement from the locking receptacles and a second position during the compression braking mode in which the locking pins are forced outwardly under pressure from the working fluid into engagement with the locking receptacles.

10. The compression braking system of claim 9, wherein the lash assembly includes a check valve in the interior at the first end of the housing to control a flow of working fluid into and out of the interior of the housing, the lash assembly further including a lash adjuster extending from the check valve toward the second end of the housing, the first and second locking pins being housed in a galley of the lash adjuster, and the lash adjuster being longitudinally movable in the housing when in the non-compression braking mode to accommodate the brake bump portion of the first cam without opening the at least one exhaust valve.

11. The compression braking system of claim 10, further comprising a first biasing member biasing the first locking member relative to the lash adjuster to the first position and a second biasing member biasing the second locking member relative to the lash adjuster to the first position.

12. The compression braking system of claim 11, wherein the first and second locking pins define a switching portion of the galley therebetween for receiving the working fluid, wherein the change in pressure in the working fluid forces the first and second locking pins away from one another to move the first and second locking pins from the first position to the second position.

13. A compression braking system for an internal combustion engine, comprising:

a brake tappet that is configured to link at least one exhaust valve to an exhaust cam, the exhaust cam including a brake bump portion and an exhaust lobe, the brake tappet including:

a housing extending along a longitudinal axis;

a lash assembly in an interior of the housing, the lash assembly being longitudinally movable relative to the housing;

first and second locking pins in the housing movable relative to the lash assembly to selectively fix and release the lash assembly relative to the housing, wherein in a non-compression braking mode the locking pins are positioned so the lash assembly is longitudinally movable relative to the housing to absorb the brake bump portion acting on the brake tappet without transferring the brake bump portion to the at least one exhaust valve and the lash assembly is movable with the housing in response to the exhaust lobe acting on the brake tappet to transfer the exhaust lobe to the at least one exhaust valve; and in a compression braking mode the lash assembly is fixed relative to the housing by displacing the locking pins outwardly so that the brake bump portion and the exhaust lobe of the exhaust cam are each transferred to the at least one exhaust valve.

14. The compression braking system of claim 13, wherein the housing extends along the longitudinal axis between a first end and an opposite second end, the housing including a working fluid in the interior, wherein a change in pressure of the working fluid moves the first and second locking pins to selectively fix and release the lash assembly relative to the housing.

15. The compression braking system of claim 14, wherein the housing includes opposite first and second locking receptacles in communication with the interior, and the first and second locking pins are movable in response to the change in pressure of the working fluid to engage and disengage from respective ones of the first and second locking receptacles.

16. The compression braking system of claim 13, wherein the lash assembly includes a lash adjuster and the first and second locking pins are supported in a galley defined by the lash adjuster, and the lash assembly defines a deactivation region between a lip of the housing in the interior of the housing and an adjacent end of the lash adjuster, wherein the deactivation region is configured to allow translation of the lash adjuster to absorb the brake bump portion in the non-compression braking mode.

17. The compression braking system of claim 16, further comprising first and second biasing members that extend between a respective one of the first and second locking pins and the lash adjuster to normally bias the locking pins toward one another and in the compression braking mode the first and second locking pins are forced outwardly away from another into engagement with the housing.

18. The compression braking system of claim 17, wherein the lash adjuster defines a cavity opening toward a first end of the housing and the lash assembly includes a check valve in the cavity to control a flow of working fluid into and out of the interior of the housing.

19. The compression braking system of claim 17, wherein the lash adjuster defines a galley and the first and second locking pins define a switching portion of the galley therebetween for receiving a working fluid that is pressurizable to move the first and second locking pins relative to one another.

20. The compression braking system of claim 17, wherein the lash assembly includes a lash spring in the interior of the housing biasing the lash adjuster toward a first end of the housing.

* * * * *